United States Patent [19]

Duvivier

[11] 4,454,678

[45] Jun. 19, 1984

[54] SLOTTED PANELS WITH SLOTTED CONNECTORS

[76] Inventor: John E. Duvivier, 706 Woodland Ave., Menlo Park, Calif. 94025

[21] Appl. No.: 327,935

[22] Filed: Dec. 7, 1981

[51] Int. Cl.[3] ..... A63H 33/10

[52] U.S. Cl. ..... 446/112

[58] Field of Search ..... 46/28, 29, 30, 31, 25, 46/26

[56] References Cited

U.S. PATENT DOCUMENTS 1,111,923 9/1914 Silva ..... 46/25 X 4,074,496 2/1978 Fischer ..... 46/25 X

FOREIGN PATENT DOCUMENTS 570570 12/1957 Italy ..... 46/21

629624 12/1961 Italy ..... 46/25

*Primary Examiner*—F. Barry Shay

*Attorney, Agent, or Firm*—William J. Ruano

[57] ABSTRACT

A set of polygonal panels with novel interlocking flaps for the construction of various structures, such as buildings desk sets and the like. The panels are shown as rectangular and triangular, for illustration purposes, but may be of other polygonal shapes. Each panel has flaps along its sides, each flap having a wide central slot and two narrow adjoining side slots. When flaps of adjacent panels are placed in superimposed matching relationship, a pair of locking elements having radial grooves are introduced singly into the center slots and are separately moved into the side slots to firmly lock the adjacent panels by two locking elements, one in each of the side slots.

6 Claims, 4 Drawing Figures

SLOTTED PANELS WITH SLOTTED CONNECTORS

This invention relates to an educational construction set and, more particularly, to panels of the same or different polygonal shape to be joined together so as to construct various objects, such as a building, furniture etc.

An outstanding disadvantage of construction sets used in the past is that separate panels are joined together by providing notches at the ends of the flaps and then rubber bands are applied to hold adjoining flaps together. Such flaps tend to come apart because of the yieldability of the rubber bands. Furthermore, the construction is not rigid when completed.

An object of the present invention is to provide an improved educational construction set that is devoid of the above-named disadvantages.

A more specific object of the present invention is to provide a novel means for interlocking flaps of adjacent panels to facilitate the speed of construction as well as to provide firm interlocking and reinforcement along the edges of adjoining panels when secured together.

Other objects and advantages of the invention will become more apparent from a study of the following description, taken with the accompanying drawing wherein.

Figure 1:
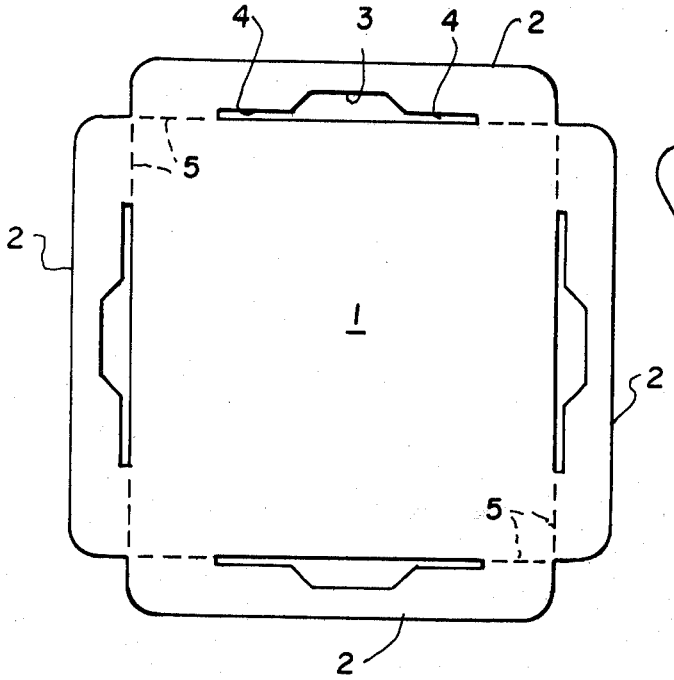
FIG. 1 is a plan view of a rectangular panel having flaps constructed in accordance with the present invention.

Referring more particularly to FIG. 1 of the drawing, numeral 1 denotes a rectangular panel having flaps, such as 2, one for each of the four sides. Each flap is provided with a central slot 3 of substantial width, for example about $\frac{3}{4}$ inch which tapers into narrower side slots 4 of a width, for example, of about $\frac{1}{8}''$. Crease lines 5 are provided, along which the flaps such as 2 may be partially folded.

Figure 2:
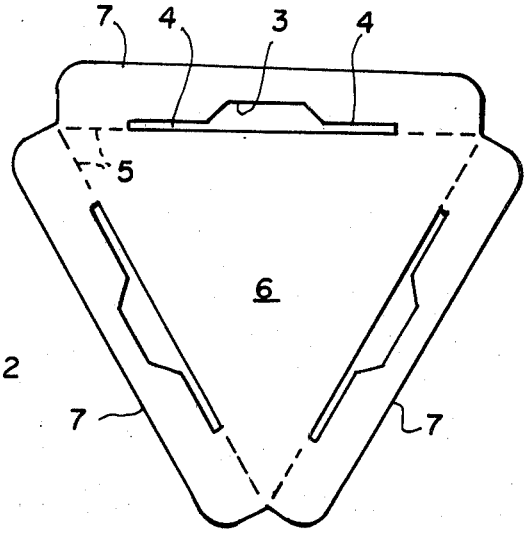
FIG. 2 shows a triangular panel with identical flaps such as shown in FIG. 1.

FIG. 2 shows a triangular panel 6 having flaps 7 of the same construction and the same length, as well as the same slot opening, as shown in FIG. 1 so that when flaps of adjoining panels are superimposed, they will exactly match. A locking element of the construction shown in FIG. 3, is introduced first into central slot 3 and then into each of the side slots 4.

Figure 3:
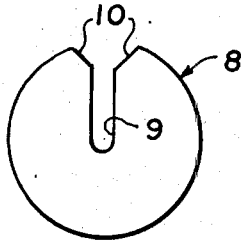
FIG. 3 is a plan view of one of the locking elements used to interlock adjacent, superimposed flaps,-there being a pair of such locking elements for each pair of superimposed flaps.
Figure 4:
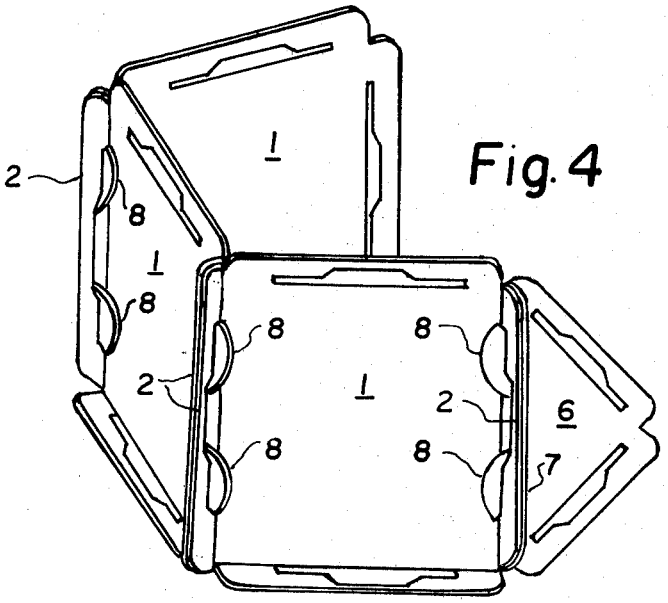
FIG. 4 shows a simple structure illustrating how panels having a different number of sides or the same number of sides are interconnected.

FIG. 3 shows a disc-shaped locking element or piece 8 having a radial slot 9 terminating in a flared opening 10.

In operation, in order to join together two polygonal panels, such as the triangular panel 6 and rectangular panel 1, the flaps of one of the sides of each panel are partly folded along their crease lines and are superimposed so as to exactly match. These flaps are then interlocked by taking a pair of locking elements of the construction shown in FIG. 3 and sliding the slot 9 of a locking element along one of the side slots 4 until the bottom of slot 9 engages the end of side slot 4. The width of slot 9 must be twice the thickness of one of the flaps, such as 2 or 7. A pair of locking elements 8 are required, one for insertion into each of the superimposed side slots 4.

While by way of example, triangular and rectangular panels have been illustrated, other shapes may be used instead, such as pentagonal, hexagonal, octagonal etc. And while locking element 8 has been illustrated as circular, it may be, instead rectangular, octagonal or of other shapes.

The panels such as 1 and 6 and their flaps are preferably constructed of cardboard, although it will be noted that they may be made of any other suitable material, such as plastic, paperboard, metal etc.

It will be readily understood that by having panels of different polygonal shapes, erection of all kinds of constructions may be made, such as those of buildings, furniture, or any other set desired.

Thus it will be seen that I have provided an educational set which is simple to put together and may be done so by small children and which provides education and amusement to such children in erecting constructions of all kinds and wherein adjoining panels are easily connected together and firmly interlocked as well as reinforced so that the resulting construction will be substantial rigidity and permanency.

While I have illustrated and described a single embodiment of my invention, it will be understood that this is by way of illustration only and that various changes and modifications may be contemplated in my invention and within the scope of the following claims.

I claim:

1. For use in building multi-panel educational constructions of various shapes, a plurality of polygonal panels having along each of their marginal edges elongated marginal flaps matching in length, and width and thickness and having fold lines to enable folding said flaps at dihedral angles relative to said panels, cutouts formed centrally of said flaps adjoining said fold lines, a pair of locking pieces of uniform thickness for interlocking a pair of adjoining panels and being of slightly smaller overall dimension and of substantially smaller width than said cutouts, slots in said flaps adjoining the ends of each of said cutouts in communicating relationship therewith and of a width corresponding to the thickness of said locking pieces, said locking pieces each having only a single slot extending outwardly from the center thereof and of a width double the thickness of said flaps, extending to the center thereof whereby when said flaps of a pair of adjoining panels are superimposed in congruent relationship and when a pair of said locking pieces are introduced into said cutouts of said pair of adjoining panels and moved laterally with their slots extending to the ends of said slots in said flaps, they will effect firm interlocking of said adjoining panels.

2. The structure recited in claim 1 wherein said panels and said locking pieces are of cardboard.

3. The structure recited in claim 1 wherein said locking pieces are circular and provided with flared openings at the extremity of their radially outwardly extending slots.

4. The structure recited in claim 1 wherein said adjoining panels have different numbers of sides.

5. The structure recited in claim 4 wherein one of said panels is triangular and the other rectangular.

6. The structure recited in claim 1 wherein both of said adjoining panels have the same number of sides.

* * * * *